US009377211B2

(12) United States Patent
Yamashita et al.

(10) Patent No.: US 9,377,211 B2
(45) Date of Patent: Jun. 28, 2016

(54) OUTDOOR UNIT AND AIR-CONDITIONING APPARATUS

(75) Inventors: Koji Yamashita, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 644 days.

(21) Appl. No.: 13/823,276

(22) PCT Filed: Oct. 14, 2010

(86) PCT No.: PCT/JP2010/006113

§ 371 (c)(1),
(2), (4) Date: Mar. 14, 2013

(87) PCT Pub. No.: WO2012/049710

PCT Pub. Date: Apr. 19, 2012

(65) Prior Publication Data

US 2013/0174592 A1 Jul. 11, 2013

(51) Int. Cl.
*F24F 11/04* (2006.01)
*F24F 11/00* (2006.01)
(Continued)

(52) U.S. Cl.
CPC ..... *F24F 11/001* (2013.01); *F24F 1/06* (2013.01); *F24F 11/0086* (2013.01); *F25B 49/005* (2013.01); *F24F 2011/0084* (2013.01); *F25B 13/00* (2013.01); *F25B 25/005* (2013.01); *F25B 2313/0294* (2013.01); *F25B 2400/121* (2013.01); *F25B 2500/222* (2013.01)

(58) Field of Classification Search
CPC ... F24F 1/06; F24F 11/001; F24F 2011/0084; F25B 13/00; F25B 49/005; F25B 2313/0294; F25B 2400/12; F25B 2400/121; F25B 2500/222
USPC ..... 62/149, 180, 186
See application file for complete search history.

(56) References Cited

U.S. PATENT DOCUMENTS

2002/0178738 A1* 12/2002 Taira ..... F24F 11/0086 62/129

FOREIGN PATENT DOCUMENTS

JP 09-264641 A 10/1997
JP 2000-006801 A 1/2000
(Continued)

OTHER PUBLICATIONS

Office Action dated Dec. 22, 2014 issued in corresponding CN patent application No. 201080069569.3 (and English translation).
(Continued)

*Primary Examiner* — Marc Norman
(74) *Attorney, Agent, or Firm* — Posz Law Group, PLC

(57) ABSTRACT

An outdoor unit includes a compressor that compresses a flammable refrigerant, a heat source side heat exchanger that exchanges heat between the refrigerant and air in an unconditioned space, an outdoor unit air-sending device disposed at a position where the air is enabled to flow out of a housing to the outside, the outdoor unit air-sending device being driven to maintain the concentration of the refrigerant in the housing at or below a predetermined concentration, and an outdoor unit controller that controls an operation of the compressor and an operation of the outdoor air-sending device. The outdoor unit controller allows the outdoor unit air-sending device to operate in order to maintain the concentration of the refrigerant at or below the predetermined concentration even when the compressor is stopped.

19 Claims, 5 Drawing Sheets

(51) Int. Cl.

| | |
|---|---|
| ***F24F 1/06*** | (2011.01) |
| ***F25B 49/00*** | (2006.01) |
| *F25B 13/00* | (2006.01) |
| *F25B 25/00* | (2006.01) |

(56) References Cited

FOREIGN PATENT DOCUMENTS

| | | | |
|---|---|---|---|
| JP | 2000-097505 | A | 4/2000 |
| JP | 2002-115939 | A | 4/2002 |
| WO | 2010/049998 | A1 | 5/2010 |
| WO | 2010/109571 | A1 | 9/2010 |

OTHER PUBLICATIONS

International Search Report of the International Searching Authority mailed Nov. 22, 2010 for the corresponding international application No. PCT/JP2010/006113 (with English translation).

* cited by examiner

OUTDOOR UNIT AND AIR-CONDITIONING APPARATUS

CROSS REFERENCE TO RELATED APPLICATION

This application is a U.S. national stage application of PCT/JP2010/006113 filed on Oct. 14, 2010.

TECHNICAL FIELD

The present invention relates to an air-conditioning apparatus that is applied to, for example, a multi-air-conditioning apparatus for an office building.

BACKGROUND ART

An air-conditioning apparatus, such as a multi-air-conditioning apparatus for an office building, has been developed which conditions air by, for example, allowing a refrigerant circulating between an outdoor unit and a relay unit to exchange heat with a heat medium, such as water, circulating between the relay unit and an indoor unit. This apparatus reduces conveyance power for the heat medium and thus saves energy. (refer to Patent Literature 1, for example).

Another air-conditioning apparatus has been developed which takes measures against refrigerant leakage in the use of hydrocarbon as a refrigerant. In this air-conditioning apparatus, a solenoid valve blocks a refrigerant passage upon refrigerant leakage (refer to Patent Literature 2, for example).

Furthermore, another air-conditioning apparatus has been developed which avoids an explosion upon refrigerant leakage in the use of a flammable refrigerant. In this air-conditioning apparatus, when a refrigerant leakage sensor, disposed in an outdoor unit housing, detects the leakage of the refrigerant, a damper for discharging refrigerant is activated. An air-sending device is then activated so as to send air into the housing (refer to Patent Literature 3, for example).

CITATION LIST

Patent Literature

Patent Literature 1: WO10/049,998 (Page 3, FIG. 1, for example)

Patent Literature 2: Japanese Unexamined Patent Application Publication No. 2000-6801 (Page. 2, FIG. 1, for example)

Patent Literature 3: Japanese Unexamined Patent Application Publication No. 2002-115939 (Page. 5, FIG. 3, for example)

SUMMARY OF INVENTION

Technical Problem

The air-conditioning apparatus, such as a multi-air-conditioning apparatus for an office building, disclosed in Patent Literature 1 is configured such that the refrigerant is circulated between the outdoor unit and the relay unit, the heat medium, such as water, is circulated between the relay unit and the indoor unit, and the relay unit allows the refrigerant to exchange heat with the heat medium, such as water. The refrigerant can be prevented from leaking into an indoor side. Disadvantageously, measures against refrigerant leakage into a housing of, for example, the outdoor unit are not taken, which may lead to a problem when the refrigerant is flammable.

The air-conditioning apparatus disclosed in Patent Literature 2 performs, upon refrigerant leakage, a process of blocking the passage with the solenoid valve, namely, an operation of stopping the leakage of refrigerant. The operation, however, is not described in detail in Patent Literature 2. Furthermore, the rate of air flow through an air-sending device is not specified.

The air-conditioning apparatus disclosed in Patent Literature 3 is configured such that, when refrigerant leakage is detected during operation of the unit, the air-sending device is rotated backward to activate the damper for discharging refrigerant. The air-sending device, however, cannot be operated while the unit is stopped. Furthermore, the rate of air flow through an air-sending device is not specified.

The invention has been made to overcome the above-described problem and provides an outdoor unit and an air-conditioning apparatus which are capable of preventing a refrigerant in a housing from increasing in concentration due to leakage of the refrigerant in the housing and thus increasing safety.

Solution to Problem

An outdoor unit according to the invention includes a compressor that compresses a flammable refrigerant, a heat source side heat exchanger exchanging heat between the refrigerant and air, and an outdoor unit air-sending device disposed at a position where the air is enabled to flow out of a housing to outside thereof, the outdoor unit air-sending device being driven to maintain the concentration of the refrigerant in the housing at or below a predetermined concentration. The outdoor unit can thereby ensure safety and enhance energy efficiency even when the refrigerant leaks.

Advantageous Effects of Invention

An air-conditioning apparatus according to this invention includes the outdoor unit air-sending device disposed in the outdoor unit. The concentration of the refrigerant can be maintained at or below the predetermined concentration at all times. Accordingly, if the refrigerant leaks, ignition or the like can be prevented. Thus, for example, the outdoor unit with high safety can be provided.

DESCRIPTION OF EMBODIMENTS

Embodiment 1

Figure 1:
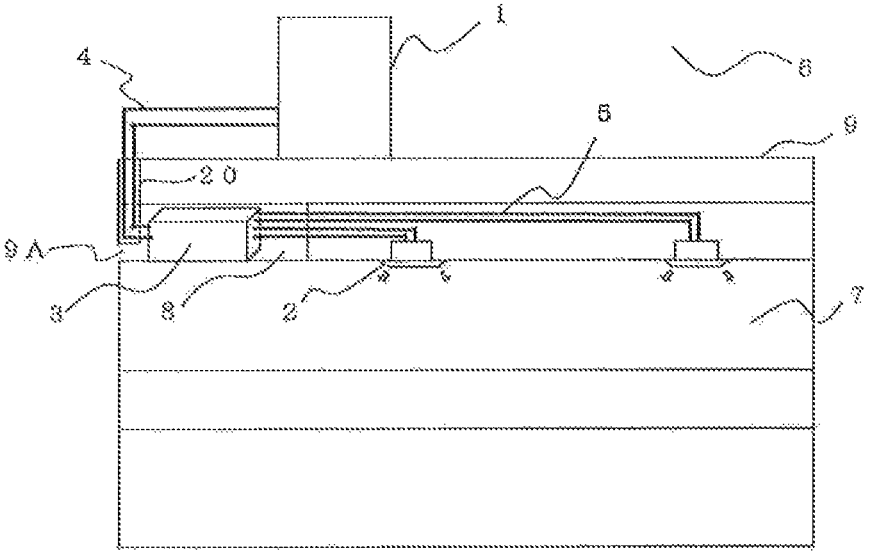
FIG. 1 is a system configuration diagram of an air-conditioning apparatus according to Embodiment 1 of the invention.
Figure 2:
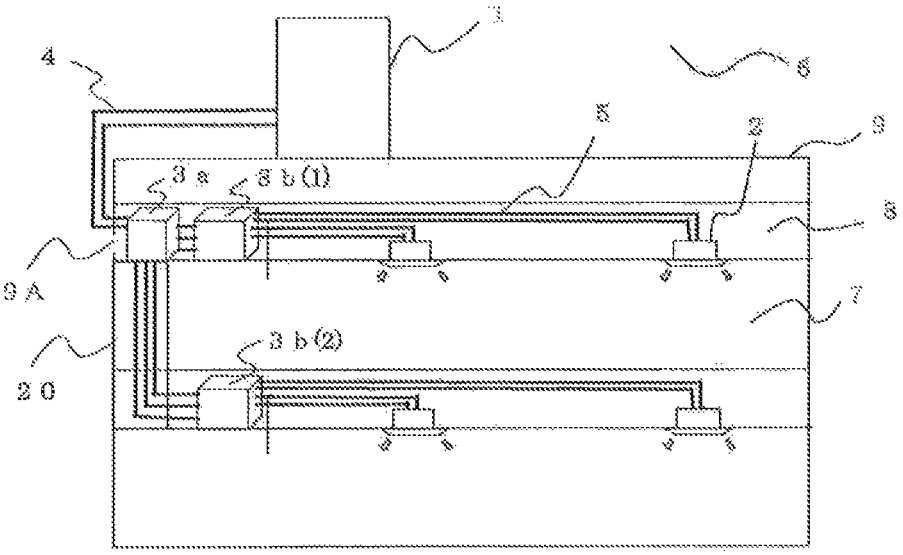
FIG. 2 is another system configuration diagram of the air-conditioning apparatus according to Embodiment 1 of the invention.

Embodiment 1 of the invention will be described with reference to the drawings. FIGS. 1 and 2 are schematic diagrams illustrating exemplary installations of the air-conditioning apparatus according to Embodiment 1 of the invention. The exemplary installations of the air-conditioning apparatus will be described with reference to FIGS. 1 and 2. In the air-conditioning apparatus, each indoor unit can freely select an operation mode from a cooling mode and a heating mode with the use of devices including instruments and the like forming circuits (a refrigerant circuit (refrigeration cycle) A and a heat medium circuit B) through which a flammable heat source side refrigerant (refrigerant) and a heat medium, serving as a refrigerant, such as water, are made to circulate, respectively. Note that the dimensional relationship among components in FIG. 1 and the other figures may be different from the actual one. Furthermore, concerning a plurality of devices and the like of the same kind that are distinguished with respective suffixes, if there is no need to distinguish or identify each of them, the suffixes may be omitted.

Referring to FIG. 1, the air-conditioning apparatus according to Embodiment 1 includes a single outdoor unit 1, functioning as a heat source unit, a plurality of indoor units 2, and a heat medium relay unit 3 disposed between the outdoor unit 1 and the indoor units 2. The heat medium relay unit 3 is configured to exchange heat between the heat source side refrigerant circulating in the refrigerant circuit and the heat medium, serving as a load (object for heat exchange) for the heat source side refrigerant. The outdoor unit 1 is connected to the heat medium relay unit 3 with refrigerant pipes 4 through which the heat source side refrigerant is conveyed. The heat medium relay unit 3 is connected to each indoor unit 2 with pipes (heat medium pipes) 5 through which the heat medium is conveyed. Cooling energy or heating energy generated in the outdoor unit 1 is delivered through the heat medium relay unit 3 to the indoor units 2.

Referring to FIG. 2, the air-conditioning apparatus according to Embodiment 1 includes the single outdoor unit 1, the plurality of indoor units 2, and a plurality of separated heat medium relay units 3 (a main heat medium relay unit 3*a* and sub heat medium relay units 3*b*) arranged between the outdoor unit 1 and the indoor units 2. The outdoor unit 1 and the main heat medium relay unit 3*a* are connected with the refrigerant pipes 4. The main heat medium relay unit 3*a* and the sub heat medium relay units 3*b* are connected with the refrigerant pipes 4. The sub heat medium relay units 3*b* are connected to the indoor units 2 by the pipes 5. Cooling energy or heating energy (heat quantity) generated in the outdoor unit 1 is delivered through the main heat medium relay unit 3*a* and the sub heat medium relay units 3*b* to the indoor units 2.

The outdoor unit 1 is typically disposed in an outdoor space 6 which is a space (e.g., a roof) outside of a structure 9, such as an office building, and is configured to supply cooling energy or heating energy through the heat medium relay unit 3 to the indoor units 2. Each indoor unit 2 is disposed at a position such that it can supply cooling air or heating air to an indoor space 7, which is a space (e.g., a living room) inside of the structure 9, and is configured to supply the cooling air or heating air to the indoor space 7, as a space to be conditioned. The heat medium relay unit 3 is configured so as to include a housing separated from housings of the outdoor unit 1 and the indoor units 2 such that the heat medium relay unit 3 can be disposed at a position different from those of the outdoor space 6 and the indoor space 7. The heat medium relay unit 3 is connected to the outdoor unit 1 through the refrigerant pipes 4 and is connected to the indoor units 2 through the pipes 5 to transfer cooling energy or heating energy, supplied from the outdoor unit 1, to the indoor units 2.

As illustrated in FIGS. 1 and 2, in the air-conditioning apparatus according to Embodiment 1, the outdoor unit 1 is connected to the heat medium relay unit 3 with two refrigerant pipes 4, and the heat medium relay unit 3 is connected to each indoor unit 2 with two pipes 5. As described above, in the air-conditioning apparatus according to Embodiment 1, each of the units (the outdoor unit 1, the indoor units 2, and the heat medium relay unit 3) is connected with two pipes (the refrigerant pipes 4 or the pipes 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) branched off from the main heat medium relay unit 3*a*. This separation allows a plurality of sub heat medium relay units 3*b* to be connected to the single main heat medium relay unit 3*a*. In this configuration, the main heat medium relay unit 3*a* is connected to each sub heat medium relay unit 3*b* by three refrigerant pipes 4. Detail of this circuit will be described in detail later (refer to FIG. 3A).

Furthermore, FIGS. 1 and 2 illustrate a state where each heat medium relay unit 3 is disposed in the structure 9 but in a space different from the indoor space 7, for example, a space above a ceiling (hereinafter, simply referred to as a "space 8"). Space 8 is not a closed space and is structured to allow ventilation to the outdoor space 6 by means of a vent hole 9A provided in the structure. The vent hole 9A in the structure may be any type capable of permitting air flow to/from the outdoor space 6 due to natural convection or forced convection to prevent an excessive increase in concentration of the heat source side refrigerant in the space 8 upon leakage of the heat source side refrigerant into the space 8. Furthermore, although FIGS. 1 and 2 illustrate a case where the indoor units 2 are of a ceiling cassette type, the indoor units are not limited to this type and may be of any type, such as a ceiling concealed type or a ceiling suspended type, as long as the indoor units 2 are capable of blowing out heating air or cooling air into the indoor space 7 directly or through a duct or the like.

In the air-conditioning apparatus in FIGS. 1 and 2, a flammable refrigerant is used as the heat source side refrigerant circulating in the refrigerant circuit. Examples of the flammable refrigerant used include tetrafluoropropene expressed by the chemical formula C3H2F4 (for example, HFO1234yf expressed by CF3CF=CH2 or HFO1234ze expressed by CF3CH═CHF) and difluoromethane (R32) expressed by the chemical formula CH2F2. Alternatively, a refrigerant mixture containing the above refrigerants may be used. In the use of the refrigerant mixture, for example, HFO1234yf is 80% and R32 is 20%. Alternatively, a high flammable refrigerant, such as R290 (propane), may be used.

Accordingly, other than the space above a ceiling, the heat medium relay unit 3 may be disposed in any place that is a space other than a living space and that has a ventilation of any kind to outside. For example, it is possible to dispose the heat medium relay unit 3 in a common space where an elevator or the like is installed which is a space that has ventilation to outside.

Although FIGS. 1 and 2 illustrate the case in which the outdoor unit 1 is disposed in the outdoor space 6, the arrangement is not limited to this case. For example, the outdoor unit 1 can be disposed in the structure 9 or the like as long as there is ventilation to the outdoor space 6.

Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to Embodiment 1 is installed.

Furthermore, it is preferred that air flow should not be allowed between the indoor space 7 and the space 8, where the heat medium relay unit 3 is placed, in order to prevent the heat source side refrigerant from leaking into the indoor space 7 even when the heat source side refrigerant leaks from the heat medium relay unit 3. However, even in a case in which a small vent, such as a hole through which a pipe extends, is disposed between the space 8 and the indoor space 7, as long as air-flow resistance in the vent between the space 8 and the indoor space 7 is set greater than that in the vent between the space 8 and the outdoor space 6, there is no problem because the leaked heat source side refrigerant is discharged to the outdoors.

In addition, as illustrated in FIGS. 1 and 2, the refrigerant pipes 4 connecting the outdoor unit 1 and the heat medium relay unit 3 extend via the outdoor space 6 or through a pipe shaft 20. The pipe shaft is a duct through which a pipe extends and is enclosed by, for example, metal. Accordingly, even when the heat source side refrigerant leaks from any of the refrigerant pipes 4, the refrigerant is not spread to the vicinity. Since the pipe shaft is disposed in an unconditioned space excluding the living space or, alternatively, the outdoors, the heat source side refrigerant leaked from the refrigerant pipe 4 will be discharged from the pipe shaft via the unconditioned space 8 or directly to the outdoors without leaking into the indoor space. Alternatively, the heat medium relay unit 3 may be disposed in the pipe shaft.

Figure 3:
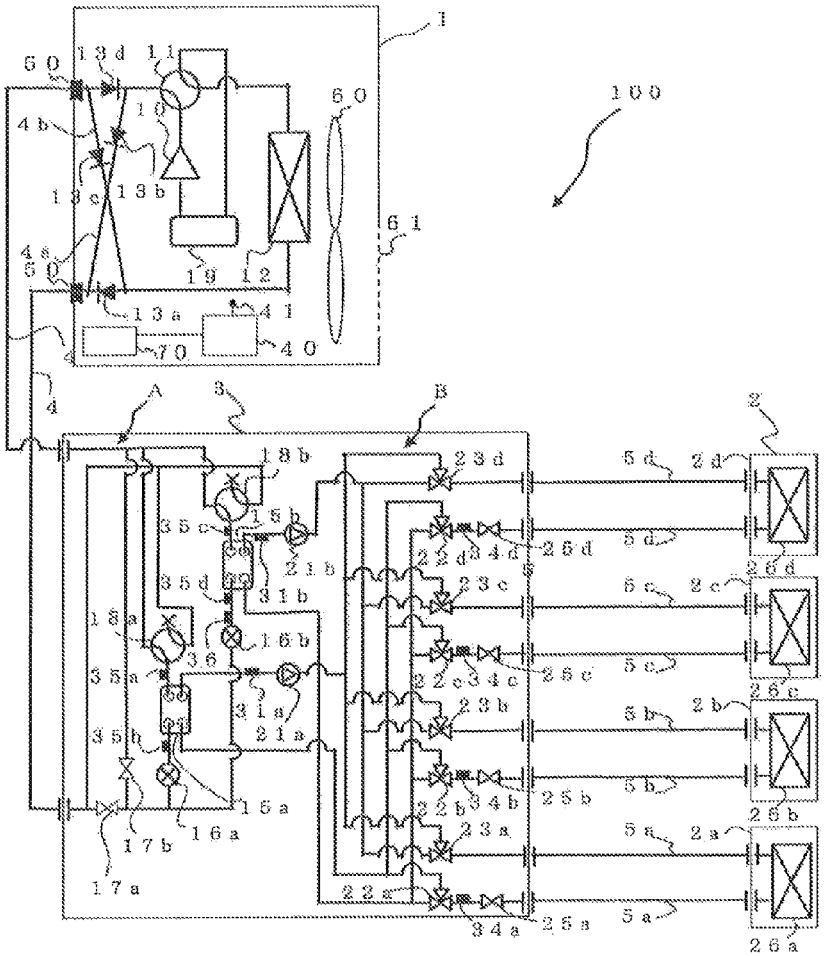
FIG. 3 is a system circuit diagram of the air-conditioning apparatus according to Embodiment 1 of the invention.

FIG. 3 is a schematic circuit diagram illustrating an exemplary circuit configuration of the air-conditioning apparatus (hereinafter, referred to as an "air-conditioning apparatus 100") according to Embodiment 1. The detailed configuration of the air-conditioning apparatus 100 will be described with reference to FIG. 3. As illustrated in FIG. 3, the outdoor unit 1 and the heat medium relay unit 3 are connected with the refrigerant pipes 4 through heat exchangers 15*a* and 15*b* related to heat medium included in the heat medium relay unit 3. Furthermore, the heat medium relay unit 3 and the indoor units 2 are connected with the pipes 5 through the heat exchangers 15*a* and 15*b* related to heat medium. Note that the refrigerant pipes 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19, which are connected in series by the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. Such an arrangement of the first connecting pipe 4*a*, the second connecting pipe 4*b*, the check valve 13*a*, the check valve 13*b*, the check valve 13*c*, and the check valve 13*d* enables the heat source side refrigerant, allowed to flow into the heat medium relay unit 3, to flow in a constant direction irrespective of an operation requested by any indoor unit 2.

The compressor 10 is configured to suction the heat source side refrigerant and compress the heat source side refrigerant to a high temperature, high pressure state, and may be a capacity-controllable inverter compressor, for example. The first refrigerant flow switching device 11 switches the flow of the heat source side refrigerant between a heating operation (a heating only operation mode and a heating main operation mode) and a cooling operation (a cooling only operation mode and a cooling main operation mode). The heat source side heat exchanger 12 is configured to function as an evaporator during cooling operation and function as a condenser (radiator) during heating operation.

In this case, the heat source side heat exchanger 12 exchanges heat between air supplied from an outdoor unit air-sending device 60 and the heat source side refrigerant, such that the heat source side refrigerant is evaporated and gasified or condensed and liquefied. The accumulator 19 is provided on the suction side of the compressor 10 and retains excess heat source side refrigerant.

The check valve 13*d* is provided in the refrigerant pipe 4 positioned between the heat medium relay unit 3 and the first refrigerant flow switching device 11 and is configured to permit the heat source side refrigerant to flow only in a predetermined direction (the direction from the heat medium relay unit 3 to the outdoor unit 1). The check valve 13*a* is provided in the refrigerant pipe 4 positioned between the heat source side heat exchanger 12 and the heat medium relay unit 3 and is configured to permit the heat source side refrigerant to flow only in a predetermined direction (the direction from the outdoor unit 1 to the heat medium relay unit 3). The check valve 13*b* is provided in the first connecting pipe 4*a* and is configured to allow the heat source side refrigerant, discharged from the compressor 10 in the heating operation, to flow to the heat medium relay unit 3. The check valve 13*c* is provided in the second connecting pipe 4*b* and is configured to allow the heat source side refrigerant, returned from the heat medium relay unit 3 in the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1. It should be noted that FIG. 3 illustrates a case in which the first connecting pipe 4*a*, the second connecting pipe 4*b*, the check valve 13*a*, the check valve 13*b*, the check valve 13*c*, and the check valve 13*d* are provided, but the devices are not limited to this case, and they may be omitted.

In Embodiment 1, the outdoor unit 1 further includes a refrigerant concentration detection device 40 and blocking devices 50. The refrigerant concentration detection device 40 includes a refrigerant concentration sensor (concentration detecting means) 41. When determining that a concentration of the refrigerant detected by the refrigerant concentration sensor 41 is at or above a predetermined value, the refrigeration concentration detection device 40 performs a process of transmitting an instruction signal to the blocking devices 50 to block a refrigerant passage. Furthermore, to provide ventilation in the outdoor unit 1, the outdoor unit air-sending device 60 is driven so as to provide a predetermined air flow rate (greater than or equal to a ventilation air flow rate). Although Embodiment 1 is described with respect to the case in which the refrigerant concentration detection device 40 is placed in the outdoor unit 1, the refrigerant concentration detection device 40 may be placed at, for example, a position outside and near the outdoor unit 1 such that the device detects a concentration of the refrigerant in the housing of the outdoor unit 1 through, for example, a hose.

In this case, the outdoor unit 1 has an outdoor unit vent 61 at a position where air comes out of the outdoor unit air-sending device 60. Consequently, the heat source side refrigerant which has leaked into the outdoor unit 1 can be discharged to the outdoor space 6 and ventilation can be provided.

The blocking devices 50 block the refrigerant passage at a refrigerant inlet and a refrigerant outlet of the outdoor unit 1 on the basis of the instruction signal, thereby stopping the inflow and outflow of the heat source side refrigerant.

The leakage of the heat source side refrigerant from, for example, a joint in any of the pipes in the outdoor unit 1 into the outdoor unit 1 will now be described. In the use of a flammable refrigerant, such as a low flammable refrigerant or a high flammable refrigerant, as the heat source side refrigerant circulating in the refrigerant circuit, the heat source side refrigerant has a risk of catching fire, ignition, or the like (hereinafter, referred to as "ignition or the like") upon leakage. Whether the flammable refrigerant undergoes ignition or the like depends on the concentration of the refrigerant in a space. The lower the concentration is, the lower the probability of ignition or the like becomes. When the concentration is below a lower limit, ignition or the like does not occur. The limit of concentration (kg/m3) at which a flammable refrigerant does not undergo ignition or the like will be referred to as an LFL (Lower Flammability Limit). For example, even when the heat source side refrigerant leaks into the housing of the outdoor unit 1, as long as the concentration of the refrigerant can be controlled below the LFL, ignition or the like does not occur in the housing. The safety can be maintained. The LFL varies from refrigerant to refrigerant. For example, R32 has an LFL of 0.306 (kg/m3) and HFO1234yf has an LFL of 0.289 (kg/m3).

Changes in concentration of a refrigerant in a space upon refrigerant leakage into the space can be calculated by the following Expression (1), where V denotes the volume (m3) of the space, C denotes the concentration (kg/m3) of the refrigerant in the space, Mr denotes the refrigerant leakage rate (kg/s), and Q denotes the ventilation air flow rate (m3/s).

$$V \times dC/dt = Mr - C \times Q \quad (1)$$

Figure 4:
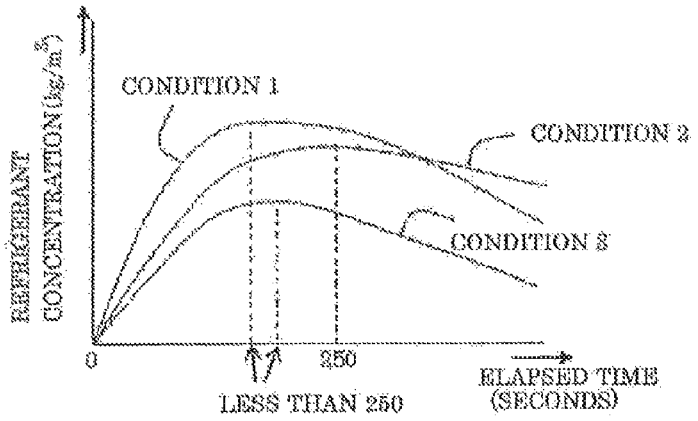
FIG. 4 is a graph showing an exemplary experimental result on changes in concentration of a refrigerant in a space.

FIG. 4 is a graph showing an exemplary experimental result on changes in concentration of a refrigerant in a space. In the case in which the refrigerant leaks from a joint in a pipe in the space where a predetermined rate of ventilation is provided, the concentration of the refrigerant in the space sharply increases from the start of leakage. As the pressure of the refrigerant in the pipe decreases, the rate of refrigerant leaking from the pipe decreases. Thus, the increase slows down. After the concentration of the refrigerant reaches its maximum value, when the rate of refrigerant leaking becomes lower than the ventilation air flow rate Q, the concentration of the refrigerant decreases.

Experiments on changes in concentration of the refrigerant upon leakage of the refrigerant from the air-conditioning apparatus into a ventilated space were performed while changing the amount of refrigerant sealed in the apparatus, a point of leakage, and another condition. As a result, it was found that the time elapsed from the start of leakage to the time when the concentration of the refrigerant reached its maximum value was 250 seconds or lower in the air-conditioning apparatus normally used (independently of the conditions).

As regards the air-conditioning apparatus which includes the refrigerant concentration detection device 40 disposed inside of the outdoor unit 1 and the blocking devices 50 arranged at the refrigerant inlet and the refrigerant outlet of the outdoor unit 1, the case will be described in which the blocking devices 50 are closed to block the refrigerant passage when the leakage of the refrigerant is detected by the refrigerant concentration detection device 40 and the detection value becomes at or above a predetermined value. Assuming that, for example, the amount of refrigerant in the refrigerant pipes inside of the outdoor unit 1 is 1 (kg), it is only necessary to consider that the refrigerant leaks at a refrigerant leakage rate Mr=0.004 (kg/s) (=1 (kg)/250 (s)). The amount of refrigerant in the refrigerant pipes inside of the indoor unit 1 is a maximum refrigerant amount during operation obtained by taking different operation modes under different environmental conditions into consideration or, alternatively, a refrigerant amount obtained by multiplying the sum (m3) of internal volumes of the refrigerant pipes and refrigeration parts inside of the outdoor unit 1 by the density (kg/m3) of the refrigerant. Assuming that the refrigerant is, for example, a liquid refrigerant, the density of the refrigerant is approximately 1000 (kg/m3). Accordingly, the refrigerant amount obtained by multiplying the sum (m3) of the internal volumes of the refrigerant pipes and devices, through which the refrigerant passes, inside of the outdoor unit 1 by 1000 (kg/m3) is the maximum refrigerant amount in the refrigerant pipes inside of the outdoor unit 1. The ventilation air flow rate Q is obtained on the basis of the maximum refrigerant amount using Expression (1), thus providing a safer air-conditioning apparatus.

When Expression (1) is solved, it is thereby indicated that the concentration of the refrigerant reaches the same level, regardless of the volume (m3) of the space. In the case where the refrigerant is R32, when the ventilation air flow rate Q provided by the outdoor unit air-sending device 60 is greater than or equal to 0.01307 (m3/s), or 0.784 (m3/min), the concentration of the refrigerant inside of the outdoor unit 1 can be controlled at or below 0.306 (kg/m3), which is the LFL of R32. In the use of HFO1234yf, when the ventilation air flow rate Q provided by the outdoor unit air-sending device 60 is greater than or equal to 0.01384 (m3/s), or 0.830 (m3/min), the concentration of the refrigerant inside of the outdoor unit 1 can be controlled at or below 0.289 (kg/m3), which is the LFL of HFO1234yf.

The refrigerant leakage rate Mr is proportional to the refrigerant amount m. Accordingly, in the case where the amount of refrigerant in the refrigerant pipes in the outdoor unit 1 is m (kg), the ventilation air flow rate Q provided by the outdoor unit air-sending device 60 may be increased by at least m times of the above-described value in order to control the concentration of the refrigerant in the housing of the outdoor unit 1 at or below the LFL. For example, in the case where R32 is used as the heat source side refrigerant, the ventilation air flow rate Q provided by the outdoor unit air-sending device 60 should be greater than or equal to 0.784×m (m3/min). Furthermore, in the case where HFO1234yf is used as the heat source side refrigerant, the ventilation air flow rate Q provided by the outdoor unit air-sending device 60 should be greater than or equal to 0.830×m (m3/min). Thus the concentration of the refrigerant in the housing of the outdoor unit 1 is controlled at or below the LFL suitable for the refrigerant, and thereby, a system can be used safely.

Furthermore, in the use of a refrigerant mixture, the ventilation air amount Q is calculated using the proportions of refrigerant components. For example, in the use of a refrigerant mixture of HFO1234yf and R32, the ventilation air flow rate Q provided by the outdoor unit air-sending device 60 may be greater than or equal to (0.784×the proportion (1/100%) of R32+0.830×the proportion (1/100%) of HFO1234yf)×m (m3/min). For example, assuming that the refrigerant mixture contains R32 at 20% and HFO1234yf at 80%, the ventilation air flow rate Q should be greater than or equal to (0.1568+0.664)×m=0.8228×m (m3/min).

In the case where R411B having an LFL of 0.239 (kg/m3) is used as the heat source side refrigerant, a ventilation air flow rate Q of 1.004×m (m3/min) or more is needed. Furthermore, in the use of R141b having an LFL of 0.43 (kg/m3), a ventilation air flow rate Q of 0.55×m (m3/min) or more is needed.

Therefore, as long as the outdoor unit air-sending device 60 capable of providing such a ventilation air flow rate Q is installed, concerning any heat source side refrigerant used in the air-conditioning apparatus (refrigerant circuit A), the concentration of the refrigerant in the housing of the outdoor unit 1 can be controlled at or below the LFL. Accordingly, such a safe system can be established.

Furthermore, in the case where R290 (propane), serving as a high flammable refrigerant, is used as the heat source side refrigerant, since the LFL of R290 is 0.038 (kg/m3), a ventilation air flow rate Q of 6.3×m (m3/min) or more is needed. In the case where R1270 (propylene) is used as the heat source side refrigerant, since the LFL of R1270 is 0.043 (kg/m3), a ventilation air flow rate Q of 5.5×m (m3/min) or more is needed.

In the above description, the blocking devices 50 are arranged to reduce the amount of refrigerant leaking from the air-conditioning apparatus as much as possible. The arrangement is not limited to this case. As regards the amount of refrigerant in the entire air-conditioning apparatus (refrigerant circuit), for example, as long as the outdoor unit air-sending device 60 has the capability of controlling the concentration of the refrigerant in the housing of the outdoor unit 1 at or below the LFL, the blocking devices 50 may be omitted. For example, when the amount of refrigerant sealed in the entire air-conditioning apparatus is m (kg) and m (kg) is 10 (kg), if R32 is used as the heat source side refrigerant, the ventilation air flow rate Q provided by the outdoor unit air-sending device 60 may be greater than or equal to 0.784 (m3/min). In the case where HFO1234yf is used as the heat source side refrigerant, the ventilation air flow rate Q may be greater than or equal to 0.830×m (m3/min). As described above, even when the blocking devices 50 are not arranged, the safety of the air-conditioning apparatus can be maintained.

As regards control of the outdoor unit air-sending device 60, the outdoor unit air-sending device 60 may be turned on or off in response to an output of the refrigerant concentration detection device 40. Alternatively, a rotation speed of the outdoor unit air-sending device 60 may be controlled in response to the output thereof.

Furthermore, when it is determined that the concentration of the refrigerant has continuously been held at or below the predetermined value for a predetermined period of time, the outdoor unit air-sending device 60 may be stopped. Additionally, the air flow rate may be controlled so as to increase or decrease.

The leakage of the refrigerant may occur while the operation of the air-conditioning apparatus is stopped (the compressor 1 is stopped). Accordingly, the refrigerant concentration detection device 40 makes determination based on the concentration of the refrigerant measured while the operation of the air-conditioning apparatus is stopped. Specifically, if a value detected by the refrigerant concentration detection device 40 exceeds the predetermined value while the compressor 10 is stopped, the refrigerant has leaked. The outdoor unit air-sending device 60 is therefore activated to control the concentration of the refrigerant in the housing of the outdoor unit 1 below the LFL. Accordingly, the safe apparatus can be provided. Furthermore, the blocking devices 50 block the refrigerant passage, thus increasing the safety of the apparatus. Furthermore, as long as the outdoor unit air-sending device 60 may be driven at all times (including the time during which the operation of the air-conditioning apparatus is stopped) so as to provide a ventilation air flow rate or more such that the concentration of the refrigerant in the housing of the outdoor unit 1 is controlled at or below the LFL, the refrigerant concentration detection device 40 may be omitted.

As described above, ventilation can typically be provided by the outdoor unit air-sending device 60 which facilitates heat exchange between outside air and the heat source side refrigerant in the heat source side heat exchanger 12. Accordingly, it is unnecessary to install an air-sending device for ventilation and efficiency is high in terms of, for example, space and cost. However, arrangement is not limited to this case. An air-sending device used exclusively for ventilation in the indoor unit 1 may be placed.

In the case where the outdoor unit 1 is placed in, for example, a machine room, a refrigerant concentration detection device having the same functions as those of the refrigerant concentration detection device 40 may be placed in the machine room and an air-sending device for ventilation may be placed at a position where air can be exhausted from the machine room to the outdoor space 6. The concentration of the refrigerant in the machine room is controlled at or below the LFL in a manner similar to the case using the outdoor unit air-sending device 60. Thus, the safety of the structure 9 using the air-conditioning apparatus can be maintained. In this case, for example, stopping the air-sending device and the air flow rate may be controlled on the basis of the concentration of the refrigerant in the machine room.

[Indoor Units 2]

The indoor units 2 each include a use side heat exchanger 26. Each of the use side heat exchangers 26 is connected by the pipes 5 to a heat medium flow control device 25 and a second heat medium flow switching device 23 arranged in the heat medium relay unit 3. Each of the use side heat exchangers 26 is configured to exchange heat between air supplied from an air-sending device, such as a fan (not illustrated), and the heat medium in order to generate heating air or cooling air to be supplied to the indoor space 7.

FIG. 3 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. Note that as is the case of FIGS. 1 and 2, the number of connected indoor units 2 illustrated in FIG. 3 is not limited to four.

[Heat Medium Relay Unit 3]

The heat medium relay unit 3 includes the two heat exchangers 15 related to heat medium, two expansion devices 16, two opening and closing devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 3A.

Each of the two heat exchangers 15 related to heat medium (the heat exchanger 15*a* related to heat medium and the heat exchanger 15*b* related to heat medium) serves as a load side heat exchanger configured to function as a condenser (radiator) or an evaporator and exchange heat such that the heat source side refrigerant transfers cooling energy or heating energy, produced by the outdoor unit 1 and stored in the heat source side refrigerant, to the heat medium. The heat exchanger 15*a* related to heat medium is disposed between an expansion device 16*a* and a second refrigerant flow switching device 18*a* in the refrigerant circuit A and is used to cool the heat medium in the cooling and heating mixed operation mode. Furthermore, the heat exchanger 15*b* related to heat medium is disposed between an expansion device 16*b* and a second refrigerant flow switching device 18*b* in the refrigerant circuit A and is used to heat the heat medium in the cooling and heating mixed operation mode. In this case, two heat exchangers 15 related to heat medium are provided. Alternatively, one heat exchanger 15 related to heat medium or three or more heat exchangers 15 related to heat medium may be provided.

The two expansion devices 16 (the expansion device 16*a* and the expansion device 16*b*) each have functions as a reducing valve and an expansion valve and are configured to reduce the pressure of the heat source side refrigerant in order to expand it. The expansion device 16*a* is disposed upstream from the heat exchanger 15*a* related to heat medium in the flow direction of the heat source side refrigerant during the cooling operation. The expansion device 16*b* is disposed upstream from the heat exchanger 15*b* related to heat medium in the flow direction of the heat source side refrigerant during the cooling operation. Each of the two expansion devices 16 may include a component having a variably controllable opening degree, for example, an electronic expansion valve.

The two opening and closing devices 17 (an opening and closing device 17*a* and an opening and closing device 17*b*) each include a two-way valve and the like, and are configured to open or close the refrigerant pipe 4. The opening and closing device 17*a* is disposed in the refrigerant pipe 4 on the inlet side of the heat source side refrigerant. The opening and closing device 17*b* is disposed in a pipe connecting the refrigerant pipe 4 on the inlet side for the heat source side refrigerant and the refrigerant pipe 4 on an outlet side therefor. The two second refrigerant flow switching devices 18 (second refrigerant flow switching devices 18*a* and 18*b*) each include, for example, a four-way valve and switch passages of the heat source side refrigerant in accordance with the operation mode. The second refrigerant flow switching device 18*a* is disposed downstream from the heat exchanger 15*a* related to heat medium in the flow direction of the heat source side refrigerant during the cooling operation. The second refrigerant flow switching device 18*b* is disposed downstream from the heat exchanger 15*b* related to heat medium in the flow direction of the heat source side refrigerant during the cooling only operation.

The two pumps 21 (pumps 21*a* and 21*b*) are configured to circulate the heat medium conveyed through the pipes 5. The pump 21*a* is disposed in the pipe 5 positioned between heat exchanger 15*a* related to heat medium and the second heat medium flow switching devices 23. The pump 21*b* is disposed in the pipe 5 between the heat exchanger 15*b* related to heat medium and the second heat medium flow switching devices 23. Each of the two pumps 21 may include, for example, a capacity-controllable pump.

The four first heat medium flow switching devices 22 (first heat medium flow switching devices 22*a* to 22*d*) each include, for example, a three-way valve and switch the heat medium passage. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding heat medium flow control device 25. Further, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) each include, for example, a three-way valve and are configured to switch the heat medium passage. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding use side heat exchanger 26. Further, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

The four heat medium flow control devices 25 (heat medium flow control devices 25*a* to 25*d*) each include, for example, a two-way valve capable of controlling the area of opening and controls the flow rate of the heat medium flowing in each pipe 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

The heat medium relay unit 3 further includes various detection devices (two heat medium discharge temperature detection devices 31, four heat medium outlet temperature detection devices 34, four refrigerant inlet/outlet temperature detection devices 35, and refrigerant pressure detection devices 36). Information (temperature information and pressure information) detected by these detecting devices is, for example, transmitted to an outdoor unit controller 70 that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 21, switching by the second refrigerant flow switching devices 18, and switching of the passage of the heat medium.

The two heat medium discharge temperature detection devices 31 (heat medium discharge temperature detection devices 31*a* and 31*b*) each detect the temperature of the heat medium discharged from a corresponding one of the heat exchangers 15 related to heat medium, or the heat medium at the outlet of the heat exchanger 15 related to heat medium, and may be, for example, thermistors or the like. The heat medium discharge temperature detection device 31*a* is disposed in the pipe 5 on the inlet side of the pump 21*a*. The heat medium discharge temperature detection device 31*b* is disposed in the pipe 5 on the inlet side of the pump 21*b*.

The four heat medium outlet temperature detection devices 34 (heat medium outlet temperature detection devices 34*a* to 34*d*) are each disposed between the corresponding first heat medium flow switching device 22 and the corresponding heat medium flow control device 25, and each detect the temperature of the heat medium discharged from the corresponding use side heat exchanger 26. The heat medium outlet temperature detection devices 34 may be thermistors or the like. The heat medium outlet temperature detection devices 34 are arranged so that the number thereof (four in this case) corresponds to the installed number of indoor units 2. Furthermore, illustrated from the bottom of the drawing are the heat medium outlet temperature detection device 34*a*, the heat medium outlet temperature detection device 34*b*, the heat medium outlet temperature detection device 34*c*, and the heat medium outlet temperature detection device 34*d* so as to correspond to the respective indoor units 2.

The four refrigerant inlet/outlet temperature detection devices 35 (refrigerant inlet/outlet temperature detection devices 35*a* to 35*d*) are each disposed on the inlet side or the outlet side of the heat source side refrigerant of the corresponding heat exchanger 15 related to heat medium, and each detect the temperature of the heat source side refrigerant flowing into the heat exchanger 15 related to heat medium or the temperature of the heat source side refrigerant discharged from the heat exchanger 15 related to heat medium. The refrigerant inlet/outlet temperature detection devices 35 may be thermistors or the like. The refrigerant inlet/outlet temperature detection device 35*a* is disposed between the heat exchanger 15*a* related to heat medium and the second refrigerant flow switching device 18*a*. The refrigerant inlet/outlet temperature detection device 35*b* is disposed between the heat exchanger 15*a* related to heat medium and the refrigerant expansion device 16*a*. The refrigerant inlet/outlet temperature detection device 35*c* is disposed between the heat exchanger 15*b* related to heat medium and the second refrigerant flow switching device 18*b*. The refrigerant inlet/outlet temperature detection device 35*d* is disposed between the heat exchanger 15*b* related to heat medium and the refrigerant expansion device 16*b*.

A refrigerant pressure detection device (pressure sensor) 36 is disposed between the heat exchanger 15*b* related to heat medium and the expansion device 16*b*, similar to the installation position of the refrigerant inlet/outlet temperature detection device 35*d*, and is configured to detect the pressure of the heat source side refrigerant flowing between the heat exchanger 15*b* related to heat medium and the refrigerant expansion device 16*b*.

Furthermore, the outdoor unit controller 70 includes a microcomputer and controls, for example, the driving frequency of the compressor 10, switching by the first refrigerant flow switching device 11, driving of the pumps 21, the opening degree of each expansion device 16, opening and closing of each opening and closing device 17, switching by each second refrigerant flow switching device 18, switching by each first heat medium flow switching device 22, switching by each second heat medium flow switching device 23, and the opening degree of each heat medium flow control device 25 on the basis of signals related to detection by the various detection devices and an instruction from a remote control to perform an operation. Although the refrigerant concentration detection device 40 is separated from the outdoor unit controller 70, the outdoor unit controller 70 may perform a process which is performed by the refrigerant concentration detection device 40. Note that the controller may be provided to each unit, or may be provided to the heat medium relay unit 3.

The pipes 5 for conveying the heat medium include the pipes connected to the heat exchanger 15*a* related to heat medium and the pipes connected to the heat exchanger 15*b* related to heat medium. Each pipe 5 is branched into the pipes 5*a* to 5*d* (four in this case) in accordance with the number of indoor units 2 connected to the heat medium relay unit 3. The pipes 5 are connected by the first heat medium flow switching devices 22 and the second heat medium flow switching devices 23. Controlling each first heat medium flow switching device 22 and each second heat medium flow switching device 23 determines whether the heat medium flowing from the heat exchangers 15*a* related to heat medium is allowed to flow into the corresponding use side heat exchanger 26 and whether the heat medium flowing from the heat exchangers 15*b* related to heat medium is allowed to flow into the corresponding use side heat exchanger 26. For example, in the case where both the heat exchanger 15*a* related to heat medium and the heat exchanger 15*b* related to heat medium cool or heat the heat medium, the control is performed such that the second heat medium flow switching device 23 permits the heat medium which has exchanged heat in the heat exchanger 15*a* related to heat medium to merge with the heat medium which has exchanged heat in the heat exchanger 15*b* related to heat medium, the resultant heat medium is allowed to flow into the use side heat exchanger 26, and the heat medium flow switching device 22 divides the heat medium into two flows, one flow returning to the heat exchanger 15*a* related to heat medium, the other flow returning to the heat exchanger 15*b* related to heat medium. Furthermore, in the case where the heat exchanger 15*a* related to heat medium cools the heat medium and the heat exchanger 15*b* related to heat medium heats the heat medium, the control is performed such that each of the first heat medium flow switching device 22 and the second heat medium flow switching device 23 are allowed to perform switching in order to select either the cooled heat medium or the heated heat medium, and the selected heat medium is allowed to flow into the use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger 15*a* related to heat medium, the refrigerant expansion devices 16, and the accumulator 19 are connected through the refrigerant pipe 4, thus forming the refrigerant circuit A. In addition, heat medium passages of the heat exchanger 15*a* related to heat medium, the pumps 21, the first heat medium flow switching devices 22, the heat medium flow control devices 25, the use side heat exchangers 26, and the second heat medium flow switching devices 23 are connected by the pipes 5, thus forming the heat medium circuits B. In other words, the plurality of use side heat exchangers 26 are connected in parallel to each of the heat exchangers 15 related to heat medium, thus turning the heat medium circuit B into a multi-system.

Accordingly, in the air-conditioning apparatus 100, the outdoor unit 1 and the heat medium relay unit 3 are connected through the heat exchanger 15*a* related to heat medium and the heat exchanger 15*b* related to heat medium arranged in the heat medium relay unit 3. The heat medium relay unit 3 and each indoor unit 2 are also connected through the heat exchanger 15*a* related to heat medium and the heat exchanger 15*b* related to heat medium. In other words, in the air-conditioning apparatus 100, the heat exchanger 15*a* related to heat medium and the heat exchanger 15*b* related to heat medium each exchange heat between the heat source side refrigerant circulating in the refrigerant circuit A and the heat medium circulating in the heat medium circuits B.

Figure 3A:
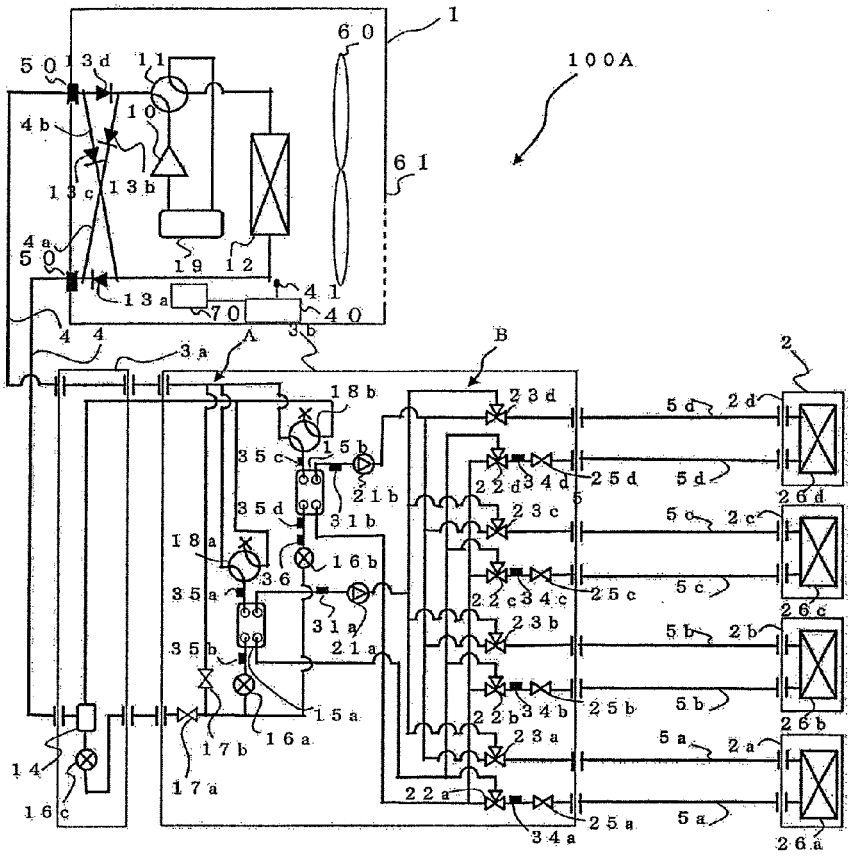
FIG. 3A is another system circuit diagram of the air-conditioning apparatus according to Embodiment 1 of the invention.

FIG. 3A is another schematic circuit diagram illustrating an exemplary circuit configuration of the air-conditioning apparatus (hereinafter, referred to as an "air-conditioning apparatus 100A") according to Embodiment of the invention. The configuration of the air-conditioning apparatus 100A in a case in which a heat medium relay unit 3 is separated into a main heat medium relay unit 3*a* and a sub heat medium relay unit 3*b* will be described with reference to FIG. 3A. As illustrate in FIG. 3A, the heat medium relay unit 3 includes the main heat medium relay unit 3*a* and the sub heat medium relay unit 3*b* that are provided in separate housings. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. The other components are arranged in the sub heat medium relay unit 3*b*. The gas-liquid separator 14 is connected to a single refrigerant pipe 4 connected to the outdoor unit 1 and is connected to two refrigerant pipes 4 connected to the heat exchanger 15*a* related to heat medium and the heat exchanger 15*b* related to heat medium in the sub heat medium relay unit 3*b*, and is configured to separate the heat source side refrigerant supplied from the outdoor unit 1 into vapor refrigerant and liquid refrigerant. The expansion device 16*c*, disposed downstream in the flow direction of the liquid refrigerant flowing out of the gas-liquid separator 14, has functions of a reducing valve and an expansion valve and is configured to reduce the pressure of the heat source side refrigerant in order to expand it. During a cooling and heating mixed operation, the pressure of the refrigerant at an outlet of the expansion device 16*c* is controlled to a medium level. The expansion device 16*c* may include a component having a variably controllable opening degree, such as an electronic expansion valve. This arrangement enables a plurality of sub heat medium relay units 3*b* to be connected to the main heat medium relay unit 3*a*.

[Refrigerant Pipes 4]

As described above, the air-conditioning apparatus 100 according to Embodiment 1 has several operation modes. In these operation modes, the heat source side refrigerant flows through the pipes 4 connecting the outdoor unit 1 and the heat medium relay unit 3.

[Pipes 5]

In some operation modes carried out by the air-conditioning apparatus 100 according to Embodiment 1, the heat medium, such as water or antifreeze, flows through the pipes 5 connecting the heat medium relay unit 3 and the indoor units 2.

Various operation modes carried out by the air-conditioning apparatus 100 will now be described. The air-conditioning apparatus 100 allows each indoor unit 2, on the basis of an instruction from the indoor unit 2, to perform a cooling operation or heating operation. Specifically, the air-conditioning apparatus 100 may allow all of the indoor units 2 to perform the same operation and also allow each of the indoor units 2 to perform different operations.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. Various operation modes carried out by the air-conditioning apparatus 100A will now be described.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are set to a medium opening degree, such that the heat medium flows into both of the heat exchanger 15*a* related to heat medium and the heat exchanger 15*b* related to heat medium. Consequently, since both of the heat exchanger 15*a* related to heat medium and the heat exchanger 15*b* related to heat medium can be used for the heating operation or the cooling operation, the heat transfer area can be increased, and accordingly the heating operation or the cooling operation can be efficiently performed.

In addition, in the case in which the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchanger 15*b* related to heat medium for heating, and the first heat medium flow switching device 22 and the second heat medium flow switching device 23 corresponding to the use side heat exchanger 26 which performs the cooling operation are switched to the passage connected to the heat exchanger 15*a* related to heat medium for cooling, so that the heating operation or cooling operation can be freely performed in each indoor unit 2.

Furthermore, each of the first heat medium flow switching devices 22 and the second heat medium flow switching devices 23 described in Embodiments may be any component which can switch passages, for example, a three-way valve capable of switching between three passages or a combination of two opening and closing valves and the like switching between two passages. Alternatively, components such as a stepping-motor-driven mixing valve capable of changing flow rates of a three-way passage or electronic expansion valves capable of changing flow rates of a two-way passage used in combination may be used as each of the first heat medium flow switching devices 22 and the second heat medium flow switching devices 23. In this case, water hammer caused when a passage is suddenly opened or closed can be prevented. Furthermore, while Embodiments describe with respect to the case in which the heat medium flow control devices 25 each include a two-way valve, each of the heat medium flow control devices 25 may include a control valve having three passages and the valve may be disposed with a bypass pipe that bypasses the corresponding use side heat exchanger 26.

Furthermore, as regards each of the use side heat medium flow control device 25, a stepping-motor-driven type that is capable of controlling a flow rate in the passage is preferably used. Alternatively, a two-way valve or a three-way valve whose one end is closed may be used. Alternatively, as regards each use side heat medium flow control device 25, a component, such as an on-off valve, which is capable of opening or closing a two-way passage, may be used while ON and OFF operations are repeated to control an average flow rate.

Furthermore, while each second refrigerant flow switching device 18 is described as a four-way valve, the device is not limited to this type. A plurality of two-way or three-way flow switching valves may be used such that the refrigerant flows in the same way.

While the air-conditioning apparatus 100 according to Embodiment 1 has been described with respect to the case in which the apparatus can perform the cooling and heating mixed operation, the apparatus is not limited to the case. Even in an apparatus that is configured by a single heat exchanger 15 related to heat medium and a single expansion device 16 to which a plurality of use side heat exchangers 26 and heat medium flow control valves 25 are connected in parallel, and is capable of carrying out only a cooling operation or a heating operation, the same advantages can be obtained.

In addition, it is needless to say that the same holds true for the case in which only a single use side heat exchanger 26 and a single heat medium flow control valve 25 are connected. Moreover, it is needless to say that there is no problem even when the heat exchanger 15 related to heat medium and the expansion device 16 acting in the same manner are arranged in plural numbers. Furthermore, while the case in which the heat medium flow control valves 25 are equipped in the heat medium relay unit 3 has been described, the arrangement is not limited to this case. Each heat medium flow control valve 25 may be disposed in the indoor unit 2. The heat medium relay unit 3 and the indoor unit 2 may be constituted in different housings.

As the heat medium, for example, brine (antifreeze), water, a mixed solution of brine and water, or a mixed solution of water and an additive with high anticorrosive effect can be used. In the air-conditioning apparatus 100, therefore, even if the heat medium leaks through the indoor unit 2 into the indoor space 7, the safety of the heat medium used is high. Accordingly, it contributes to safety improvement.

Further, although the heat source side heat exchanger 12 and the use side heat exchangers 26*a* to 26*d* are typically arranged with an air-sending device which facilitates condensation or evaporation, the arrangement is not limited to the above. For example, a panel heater, using radiation can be used as the use side heat exchangers 26*a* to 26*d* and a water-cooled heat exchanger which transfers heat using water or antifreeze can be used as the heat source side heat exchanger 12. Any component that has a structure that can transfer or remove heat may be used.

Furthermore, while an exemplary description in which there are four use side heat exchangers 26*a* to 26*d* has been given, any number can be connected.

Furthermore, description has been made illustrating a case in which there are two heat exchangers 15 related to heat medium, namely, heat exchanger 15*a* related to heat medium and heat exchanger 15*b* related to heat medium. As a matter of course, the arrangement is not limited to this case, and as long as it is configured to be capable of cooling and/or heating of the heat medium, the number of heat exchangers 15 related to heat medium arranged is not limited.

Furthermore, each of the number of pumps 21*a* and 21*b* is not limited to one. A plurality of pumps having a small capacity may be used in parallel.

Furthermore, as regards the air-sending device placed in the outdoor unit 1, it is not limited to the use in the system described above. The same holds true for a direct expansion air-conditioning apparatus in which the refrigerant is circulated to each indoor unit. The same advantages can be achieved.

As described above, in the air-conditioning apparatus (the air-conditioning apparatus 100, the air-conditioning apparatus 100A, and an air-conditioning apparatus 100B) according to Embodiment 1, when a flammable heat source side refrigerant leaks into the housing of the outdoor unit, the outdoor unit air-sending device 60 is driven to discharge the heat source side refrigerant at a predetermined ventilation air flow rate. Consequently, the concentration of the refrigerant in the housing of the outdoor unit can be prevented from increasing, so that ignition or the like can be avoided and the safety of the outdoor unit 1 and the air-conditioning apparatus can be improved. In this case, the ventilation air flow rate is set on the basis of the LFL of the heat source side refrigerant used, so that ignition or the like can be reliably prevented. In this case, since a ventilation air flow rate of 0.55×m (m3/min) or more is kept for the refrigerant amount m (kg), various refrigerants available for the air-conditioning apparatus can be coped with. In this case, since the refrigerant amount is determined on the basis of the internal volumes of the refrigerant pipes and devices in the outdoor unit 1, a ventilation air flow rate necessary for maintaining the safety can be more efficiently determined. The ventilation air flow rate is determined on the basis of an expectable maximum refrigerant amount on the assumption that the density of the refrigerant is 1000 (kg/m3). Thus, ignition or the like can be reliably prevented.

In addition, since the refrigerant concentration detection device 40 is disposed to determine the concentration of the refrigerant based on detection by the refrigerant concentration sensor 41 and the outdoor unit air-sending device 60 is driven on the basis of the determination, the outdoor unit air-sending device 60 can be efficiently driven when the concentration of the refrigerant is at or above a predetermined concentration. Furthermore, since the blocking devices 50 are arranged at the refrigerant inlet and the refrigerant outlet of the outdoor unit 1 to block the flow of the heat source side refrigerant flowing into and out of the outdoor unit 1 on the basis of a determination by the refrigerant concentration detection device 40, the amount of heat source side refrigerant leaking can be reduced. Moreover, since the amount of refrigerant leaking is small, the ventilation air flow rate Q provided by the outdoor unit air-sending device 60 and driving time can be efficiently reduced. Furthermore, the outdoor unit air-sending device 60 is also used as an air-sending device that facilitates heat exchange by the heat source side heat exchanger 12, so that only one air-sending device can be disposed in the outdoor unit 1.

Embodiment 2

Figure 5:
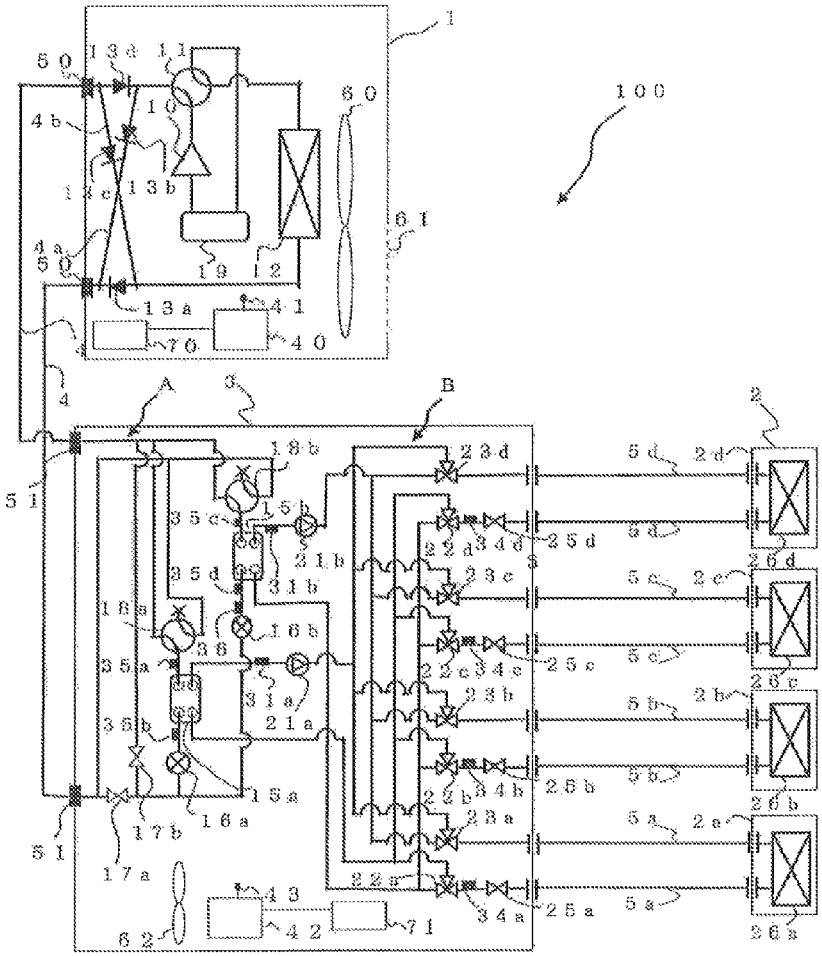
FIG. 5 is a system configuration diagram of an air-conditioning apparatus according to Embodiment 2 of the invention.

FIG. 5 is a schematic circuit diagram illustrating an exemplary circuit configuration of an air-conditioning apparatus according to Embodiment 2. In the air-conditioning apparatus 100 of FIG. 5, the heat medium relay unit 3, which exchanges heat between the heat medium, serving as a load, and the heat source side refrigerant, includes a relay unit side refrigerant concentration detection device 42 including a refrigerant concentration sensor 43, relay unit side blocking devices 51, a relay unit side air-sending device 62, and a relay unit controller 71 in a manner similar to the outdoor unit 1. This prevents ignition or the like caused by an increase in concentration of the refrigerant due to, for example, the leakage of the refrigerant in the housing of the heat medium relay unit 3. As regards the relay unit side air-sending device 62, for example, the amount of refrigerant in the heat medium relay unit 3 may be determined in a manner similar to the case of the outdoor unit 1 and the ventilation air flow rate Q may be then determined. The relay unit side air-sending device 62 is controlled by, for example, the relay unit controller 71.

Although Embodiment 2 has been described with respect to the air-conditioning apparatus including the refrigerant circuit A and the heat medium circuits B, the configuration is not limited to this. For example, Embodiment 2 can be applied to an air-conditioning apparatus which does not include the heat medium circuit B and performs direct cooling and/or heating using air in a space to be conditioned as a load on the refrigerant circuit A (the heat source side refrigerant).

1 heat source unit (outdoor unit); 2, 2*a*, 2*b*, 2*c*, 2*d* indoor unit; 3, 3*a*, 3*b* heat medium relay unit; 4, 4*a*, 4*b* refrigerant pipe; 5, 5*a*, 5*b*, 5*c*, 5*d* pipe; 6 outdoor space; 7 indoor space; 8 space; 9 structure; 9A vent hole; 10 compressor; 11 first refrigerant flow switching device (four-way valve); 12 heat source side heat exchanger; 13*a*, 13*b*, 13*c*, 13*d* check valve; 14 liquid-gas separator; 15*a*, 15*b* heat exchanger related to heat medium; 16*a*, 16*b*, 16*c* expansion device; 17*a*, 17*b* opening and closing device; 18*a*, 18*b* second refrigerant flow switching device; 19 accumulator; 20 heat exchanger related to refrigerant; 21*a*, 21*b* pump (heat medium sending device); 22*a*, 22*b*, 22*c*, 22*d* first heat medium flow switching device; 23*a*, 23*b*, 23*c*, 23*d* second heat medium flow switching device; 25*a*, 25*b*, 25*c*, 25*d* heat medium flow control device; 26*a*, 26*b*, 26*c*, 26*d* use side heat exchanger; 31*a*, 31*b* heat medium discharge temperature detection device; 34, 34*a*, 34*b*, 34*c*, 34*d* heat medium outlet temperature detection device; 35, 35*a*, 35*b*, 35*c*, 35*d* refrigerant inlet/outlet temperature detection device; 36 refrigerant pressure detection device; 40 refrigerant concentration detection device; 41, 43 refrigerant concentration sensor; 42 relay unit side refrigerant concentration detection device; 50 blocking device; 51 relay unit side blocking device; 60 outdoor unit air-sending device; 61 outdoor unit vent; 62 relay unit side air-sending device; 70 outdoor unit controller; 71 relay unit controller; 100, 100A, 100B air-conditioning apparatus; A refrigerant circuit; B heat medium circuit.

The invention claimed is:

1. An outdoor unit comprising:

a compressor that compresses a flammable refrigerant;

a heat source side heat exchanger exchanging heat between the refrigerant and air in an unconditioned space;

an outdoor unit air-sending device disposed at a position where the air is enabled to flow out of a housing to the outside, the outdoor unit air-sending device being driven to maintain a concentration of the refrigerant in the housing at or below a predetermined concentration; and an outdoor unit controller that controls an operation of the compressor and an operation of the outdoor unit air-sending device, wherein the outdoor unit controller allows the outdoor unit air-sending device to operate at a ventilation air flow rate corresponding to an amount of refrigerant in a refrigerant circuit in order to maintain the concentration of the refrigerant at or below the predetermined concentration even when the compressor is stopped, the refrigerant circuit being configured to connect the compressor, the heat source side heat exchanger, an expansion device reducing pressure of the refrigerant and a load side heat exchanger exchanging heat between the refrigerant and a load by piping.

2. The outdoor unit of claim 1, further comprising:

a refrigerant concentration detection device that detects the concentration of the refrigerant in the housing, wherein the outdoor unit air-sending device is driven on the basis of a value detected by the refrigerant concentration detection device.

3. The outdoor unit of claim 2, further comprising:

a blocking device disposed at each of a refrigerant inlet and a refrigerant outlet of the outdoor unit for blocking a flow of the refrigerant;

wherein the outdoor unit controller allows the blocking devices to block the flow of the refrigerant on the basis of the value detected by the refrigerant concentration detection device.

4. The outdoor unit of claim 2, wherein the outdoor unit controller allows the outdoor unit air-sending device to operate at a ventilation air flow rate corresponding to an amount of refrigerant in the outdoor unit among the refrigerant circuit.

5. The outdoor unit of claim 1, wherein when an amount of refrigerant is m (kg), a ventilation air flow rate provided by the outdoor unit air-sending device is greater than or equal to 0.55×m (m3/min).

6. The outdoor unit of claim 5, wherein the refrigerant amount m (kg) in the outdoor unit is a maximum amount of refrigerant permitted to exist in the outdoor unit, the maximum amount being based on a refrigerant state in an operation performed by the outdoor unit.

7. The outdoor unit of claim 5, wherein the refrigerant amount m (kg) in the outdoor unit is a product of a sum (m3) of internal volumes of refrigerant pipes and devices through which the refrigerant passes in the outdoor unit and density (kg/m3) of the refrigerant.

8. The outdoor unit of claim 5, wherein the refrigerant amount m (kg) in the outdoor unit is a product of a sum (m3) of internal volumes of refrigerant pipes and devices through which the refrigerant passes in the outdoor unit and 1000 (kg/m3).

9. The outdoor unit of claim 1, wherein the refrigerant is R32 and a ventilation air flow rate provided by the outdoor unit air-sending device is greater than or equal to 0.784×m (m3/min).

10. The outdoor unit of claim 1, wherein the refrigerant is HFO1234yf and a ventilation air flow rate Q provided by the outdoor unit air-sending device is greater than or equal to 0.830×m (m3/min).

11. The outdoor unit of claim 1, wherein the refrigerant is a refrigerant mixture of at least HFO1234yf and R32 and the rate of ventilation air flow provided by the outdoor unit air-sending device is greater than or equal to (0.784×a proportion (%) of the R32 +0.830×a proportion (%) of the HFO1234yf)×m (m3/min).

12. The outdoor unit of claim 1, wherein the refrigerant is propane and a ventilation air flow rate provided by the outdoor unit air-sending device is greater than or equal to 6.3×m (m3/min).

13. The outdoor unit of claim 1, wherein the outdoor unit air-sending device is further driven to send air to the heat source side heat exchanger in order to facilitate heat exchange between the air and the refrigerant.

14. An air-conditioning apparatus comprising:

a refrigerant circuit that includes the compressor, the heat source side heat exchanger, an expansion device reducing pressure of the refrigerant, and a load side heat exchanger exchanging heat between the refrigerant and a load such that the compressor, the heat source side heat exchanger, the expansion device, and the load side heat exchanger are connected by piping, the compressor and the heat source side heat exchanger being included in the outdoor unit of claim 1, wherein the load side heat exchanger exchanges heat between air in a space to be conditioned, serving as the load, and the refrigerant.

15. An air-conditioning apparatus comprising:

a refrigerant circuit mechanism functioning as a refrigerant circuit that includes the compressor, the heat source side heat exchanger, an expansion device reducing pressure of the refrigerant, and a load side heat exchanger exchanging heat between the refrigerant and a load such that the compressor, the heat source side heat exchanger, the expansion device, and the load side heat exchanger are connected by piping, the compressor and the heat source side heat exchanger being included in the outdoor unit of claim 1; and a heat medium side mechanism functioning as a heat medium circuit that includes a heat medium sending device for circulating a heat medium, serving as the load related to heat exchange by the load side heat exchanger, and a use side heat exchanger exchanging heat between the heat medium and air related to a space to be conditioned such that the heat medium sending device and the use side heat exchanger are connected by piping.

16. The air-conditioning apparatus of claim 15, wherein the refrigerant circuit mechanism includes a plurality of load side heat exchangers connected by piping, and wherein the heat medium circuit includes a plurality of the heat medium sending devices and a heat medium flow switching device which are further connected by piping, each heat medium sending device circulating the heat medium related to heat exchange by the corresponding load side heat exchanger, the heat medium flow switching device being configured to select either a heat medium cooled by the plurality of load side heat exchangers or a heat medium heated by the plurality of load side heat exchangers and switch between passages through which the heat medium flows to the use side heat exchanger.

17. The air-conditioning apparatus of claim 15, further comprising:

a load side air-sending device driven to maintain a concentration of the refrigerant in a housing accommodating at least one of the load side heat exchangers at or below a predetermined concentration; and a load side refrigerant concentration detection device that detects the concentration of the refrigerant in the housing accommodating at least one of the load side heat exchangers, wherein the load side air-sending device is operated on the basis of a value detected by the load side refrigerant concentration detection device.

18. The air-conditioning apparatus of claim 17, further comprising:

the outdoor unit disposed outside of a structure or a machine room positioned outside of the structure; and the housing disposed in a space which is inside of the structure and is different from the space to be conditioned and includes a machine room and the like configured to provide ventilation to the outside of the structure, the housing accommodating at least one of the load side heat exchangers.

19. The air-conditioning apparatus of claim 15, further comprising:

a load side blocking device disposed at each of a refrigerant inlet and a refrigerant outlet of a housing accommodating the load side heat exchanger, the blocking device blocking a flow of the refrigerant, wherein the blocking devices blocks the flow of the refrigerant on the basis of a value detected by the load side refrigerant concentration detection device.

* * * * *